US005690075A

United States Patent [19]

Tanaka et al.

[11] Patent Number: 5,690,075

[45] Date of Patent: Nov. 25, 1997

[54] METHOD OF AND APPARATUS FOR CONTROLLING FUEL INJECTION IN INTERNAL COMBUSTION ENGINE

[75] Inventors: Hiroshi Tanaka; Naohide Fuwa, both of Susono, Japan

[73] Assignee: Toyota Jidosha Kabushiki Kaisha, Toyota, Japan

[21] Appl. No.: 705,966

[22] Filed: Aug. 30, 1996

[30] Foreign Application Priority Data

Sep. 5, 1995 [JP] Japan ..... 7-227836

[51] Int. Cl.[6] ..... F02M 51/00

[52] U.S. Cl. ..... 123/491

[58] Field of Search ..... 123/491, 492, 123/493, 480, 419; 364/431.04

[56] References Cited

U.S. PATENT DOCUMENTS

| | | | |
|---|---|---|---|
| 5,390,641 | 2/1995 | Yamada et al. | 123/480 |
| 5,482,023 | 1/1996 | Hunt et al. | 123/491 |
| 5,542,393 | 8/1996 | Katoh et al. | 123/492 |
| 5,590,633 | 1/1997 | Tomisawa et al. | 364/431.04 |
| 5,595,161 | 1/1997 | Ott et al. | 123/419 |

FOREIGN PATENT DOCUMENTS

| | | | |
|---|---|---|---|
| A-6-146958 | 5/1994 | Japan | 123/491 |
| A-6-173746 | 6/1994 | Japan | 123/491 |
| A-6-229284 | 8/1994 | Japan | 123/491 |

*Primary Examiner*—R. A. Nelli
*Attorney, Agent, or Firm*—Oliff & Berridge

[57] ABSTRACT

A method of, and an apparatus for, controlling fuel injection in an internal combustion engine prevent lean misfires and a discharge of unburned HC at and after the start of the engine.

The apparatus has a drive circuit 50 for opening a fuel injector 12 of each cylinder at predetermined crank angles, a unit A for determining whether or not the speed of the engine is above a reference speed, a unit B for determining whether or not fuel in a cranking quantity has been injected into every cylinder of the engine, and a switching unit C for switching the quantity of fuel to be injected from the cranking quantity to a post-cranking quantity if the unit A determines that the engine speed is above the reference speed and the unit B determines that fuel in the cranking quantity has been injected into every cylinder.

2 Claims, 5 Drawing Sheets

METHOD OF AND APPARATUS FOR CONTROLLING FUEL INJECTION IN INTERNAL COMBUSTION ENGINE

BACKGROUND OF THE INVENTION

1. Field of the Invention

The present invention relates to a method of, and an apparatus for, controlling fuel injection in an internal combustion engine, and particularly, to a method of, and apparatus for, controlling fuel injection in an internal combustion engine, to inject different quantities of fuel at and after the start of the engine and to prevent lean misfires at and after the start of the engine.

2. Description of the Related Art

A prior art for controlling fuel injection in an internal combustion engine determines whether or not the speed of the engine is above a reference speed and, if it is above the reference speed, switches the quantity of fuel to inject from a cranking quantity TAUST for starting the engine to a post-cranking quantity TAU, which is calculated according to an engine load, an engine speed, etc., and is used after the engine is started. The cranking quantity TAUST is calculated by subtracting residual fuel, which is a leakage from a fuel injector into an intake duct, from a basic quantity. This prior art is intended to properly start the engine. Japanese Unexamined Patent Publication No. 6-146958 discloses a fuel injection controller that correctly calculates the fuel leakage rate of each fuel injector according to a (soak) time that the vehicle is kept in a high temperature environment and a fuel leakage and corrects the quantity of fuel to properly start the engine. Japanese Unexamined Patent Publication No. 6-229284 discloses an apparatus for controlling an air-fuel ratio at the start of an internal combustion engine. This disclosure estimates a fuel leakage from a fuel injector into an intake system between the stoppage of the engine and the next start thereof and decreases a usual cranking quantity of fuel to inject, or increases the quantity of intake air according to the estimated leakage, thereby properly starting the engine. The reason for such a decrease in the usual cranking quantity is to cancel a portion added to the usual cranking quantity on an assumption that an intake duct is dry when the engine is restarted.

If the amount residual fuel caused by leakage from a fuel injector or adhesion to the wall of an intake duct during a warm-up period is large, the fuel will burn at the start of the engine after being sucked into the combustion chambers even though fuel injection was not executed, thereby increasing the speed of the engine. When the engine speed exceeds a reference speed, the prior art switches the cranking quantity TAUST to the post-cranking quantity TAU even if some cylinders have not yet received fuel in the cranking quantity TAUST. For any cylinder which did not receive fuel in the cranking quantity TAUST, the fuel in the post-cranking quantity TAU is insufficient, thereby causing lean misfires and the discharge of unburned HC.

SUMMARY OF THE INVENTION

An object of the present invention is to provide a method of, and apparatus for, controlling fuel injection in an internal combustion engine without lean misfires or a discharge of unburned HC at or after the start of the engine.

FIG. 1 shows a basic structure of an apparatus for controlling fuel injection in an internal combustion engine according to the present invention.

The apparatus has a drive circuit 50 for controlling a fuel injector 12 to inject fuel in a cranking quantity at the start of the engine and in a post-cranking quantity after the engine is started. The apparatus consists of:

- a unit A for determining, according to a signal from a crank-angle sensor 32, whether or not the speed of the engine is above a reference speed;
- a unit B for determining whether or not fuel in the cranking quantity has been injected into every cylinder of the engine; and
- a switching unit C for switching the quantity of fuel to be injected from the fuel injector 12 from the cranking quantity to the post-cranking quantity if the unit A determines that the engine speed is above the reference speed and the unit B determines that fuel in the cranking quantity has been injected into every cylinder.

The switching unit C prevents lean misfires by switching the quantity of fuel to be injected from the cranking quantity to the post-cranking quantity if it is determined that the speed of the engine is above the reference speed and that fuel in the cranking quantity has been injected into every cylinder.

The present invention also provides a method of controlling fuel injection in an internal combustion engine.

The method injects fuel in a cranking quantity at the start of the engine and in a post-cranking quantity after the engine is started. The method includes the steps of:

- determining whether or not the speed of the engine is above a reference speed;
- determining whether or not fuel in the cranking quantity has been injected into every cylinder of the engine; and
- switching the quantity of fuel to inject from the cranking quantity to the post-cranking quantity if it is determined that the engine speed is above the reference speed and that fuel in the cranking quantity has been injected into every cylinder.

DESCRIPTION OF THE PREFERRED EMBODIMENTS

The present invention will be explained with reference to the drawings.

Figure 1:
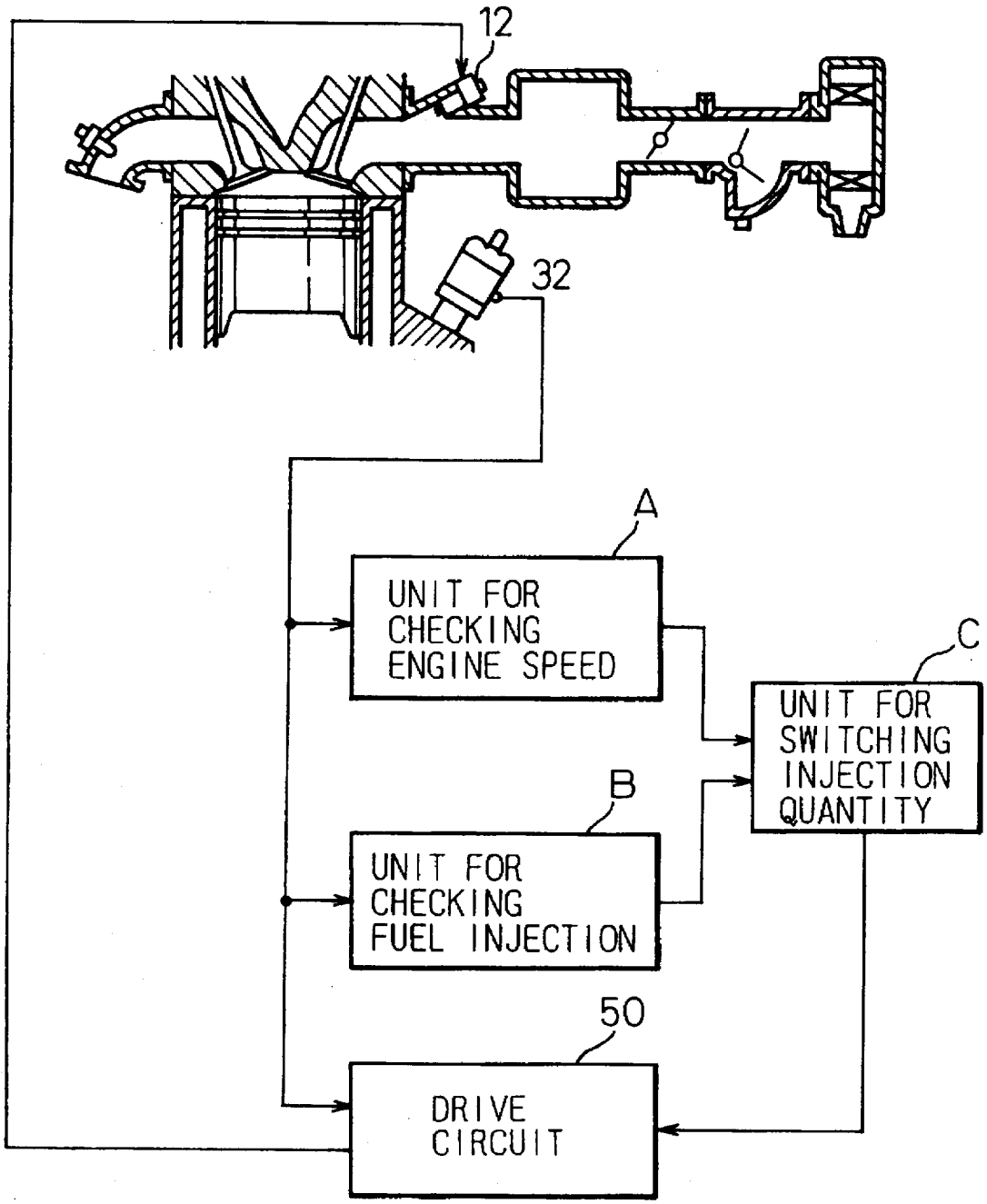
FIG. 1 shows a basic structure of an apparatus for controlling fuel injection according to the present invention.
Figure 2:
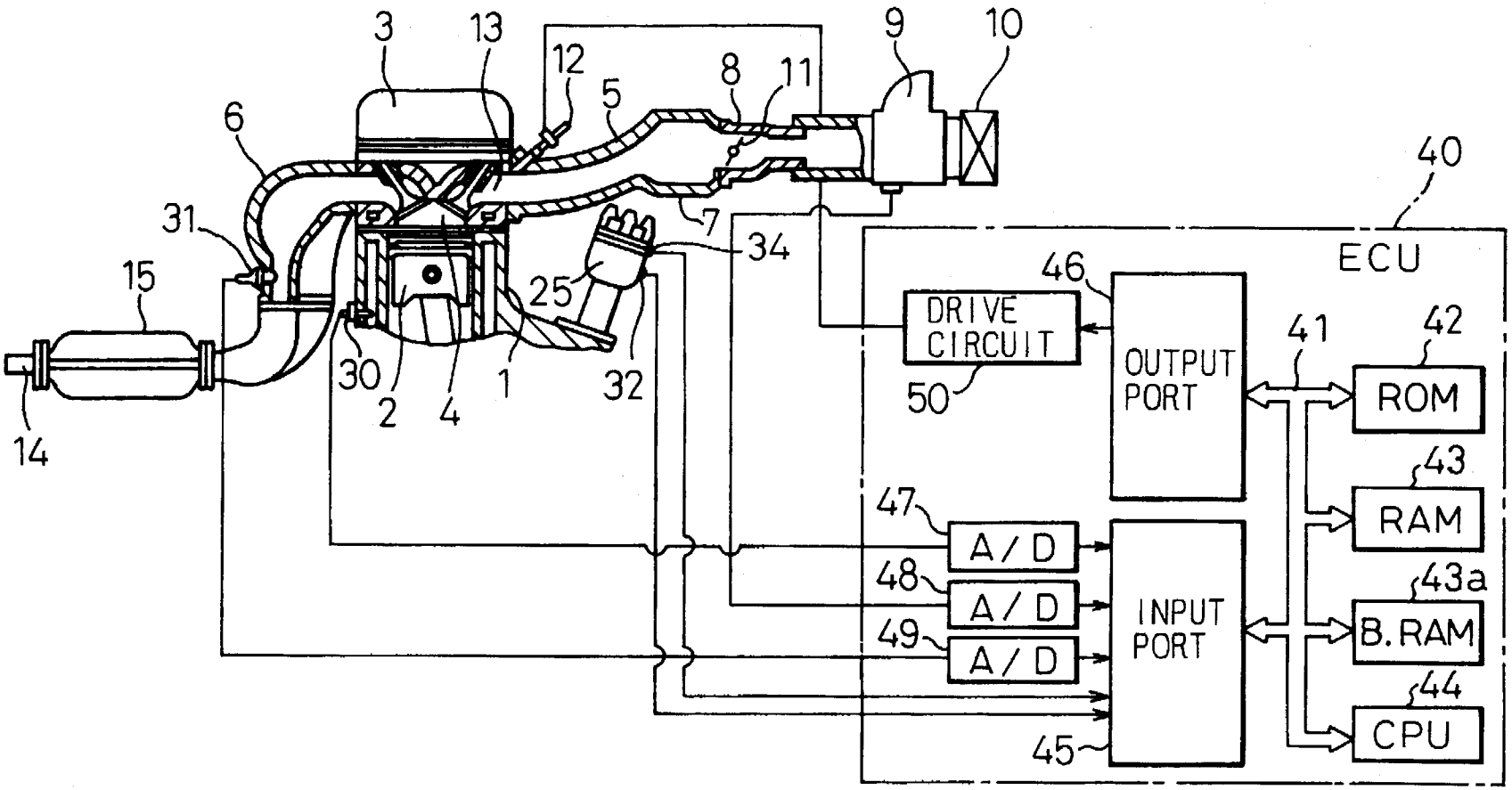
FIG. 2 shows an internal combustion engine according to an embodiment of the present invention.

FIG. 2 is a general view showing an internal combustion engine according to an embodiment of the present invention. The engine has a cylinder block 1, a piston 2, a cylinder head 3, a combustion chamber 4, an intake manifold 5, and an exhaust manifold 6. The intake manifold 5 is connected to a surge tank 7, an intake duct 8, an airflow meter 9, and an air cleaner 10. The intake duct 8 has a throttle valve 11. The intake manifold 5 has a fuel injector 12 to inject fuel toward an intake port 13. The exhaust manifold 6 is connected to an exhaust pipe 14 that incorporates a three-element catalytic converter 15 for simultaneously purifying HC, CO, and NOx.

An electronic control unit 40 is a digital computer having a ROM 42, a RAM 43, a backup RAM 43*a*, a CPU 44, an input port 45, an output port 46, and a bidirectional bus 41 that connects these components to one another. The backup RAM 43*a* stores data without voltage from a buttery. Sensors for detecting the conditions of the engine and the input ports of the electronic control unit 40 for receiving signals from the sensors will be explained. A water temperature sensor 30 detects the temperature THW of cooling water in a water jacket of the cylinder block 1. An output signal from the sensor 30 is supplied to an input port 45 through an A/D converter 47. The airflow meter 9 generates an output voltage in proportion to the quantity of intake air, and the output voltage is supplied to the input port 45 through an A/D converter 48. An air-fuel-ratio sensor 31 is arranged in the exhaust manifold 6, to detect an oxygen concentration in exhaust gas, and the detected signal is supplied to the input port 45 through an A/D converter 49. A crank-angle sensor 32 is arranged in the distributor 25, to detect a crank angle of the engine. Namely, the sensor 32 generates an output pulse every 30 degrees in crank angle. A cylinder sensor 34 generates an output pulse whenever any one of the first, fourth, sixth, and seventh cylinders reaches top dead center in a compression stroke. The output pulses from the sensors 32 and 34 are supplied to the input port 45. An output section of the electronic control unit 40 involves the output port 46 and drive circuit 50. The fuel injector 12 is connected to the drive circuit 50 and is opened according to the fuel injection control mentioned below, to inject fuel toward the intake port 13.

Figure 3:
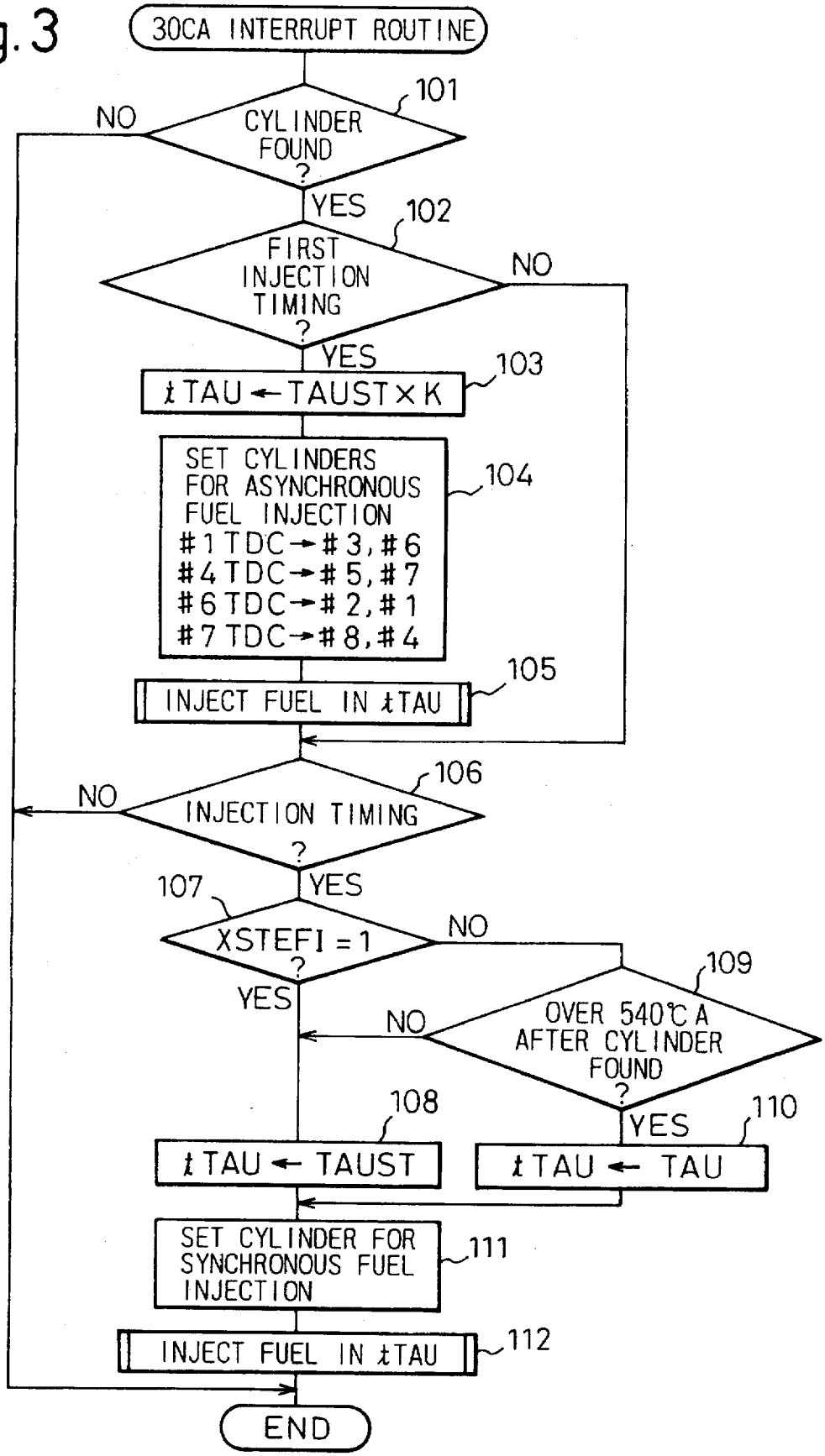
FIG. 3 is a flowchart showing a fuel injection controlling routine according to the present invention.
Figure 4:
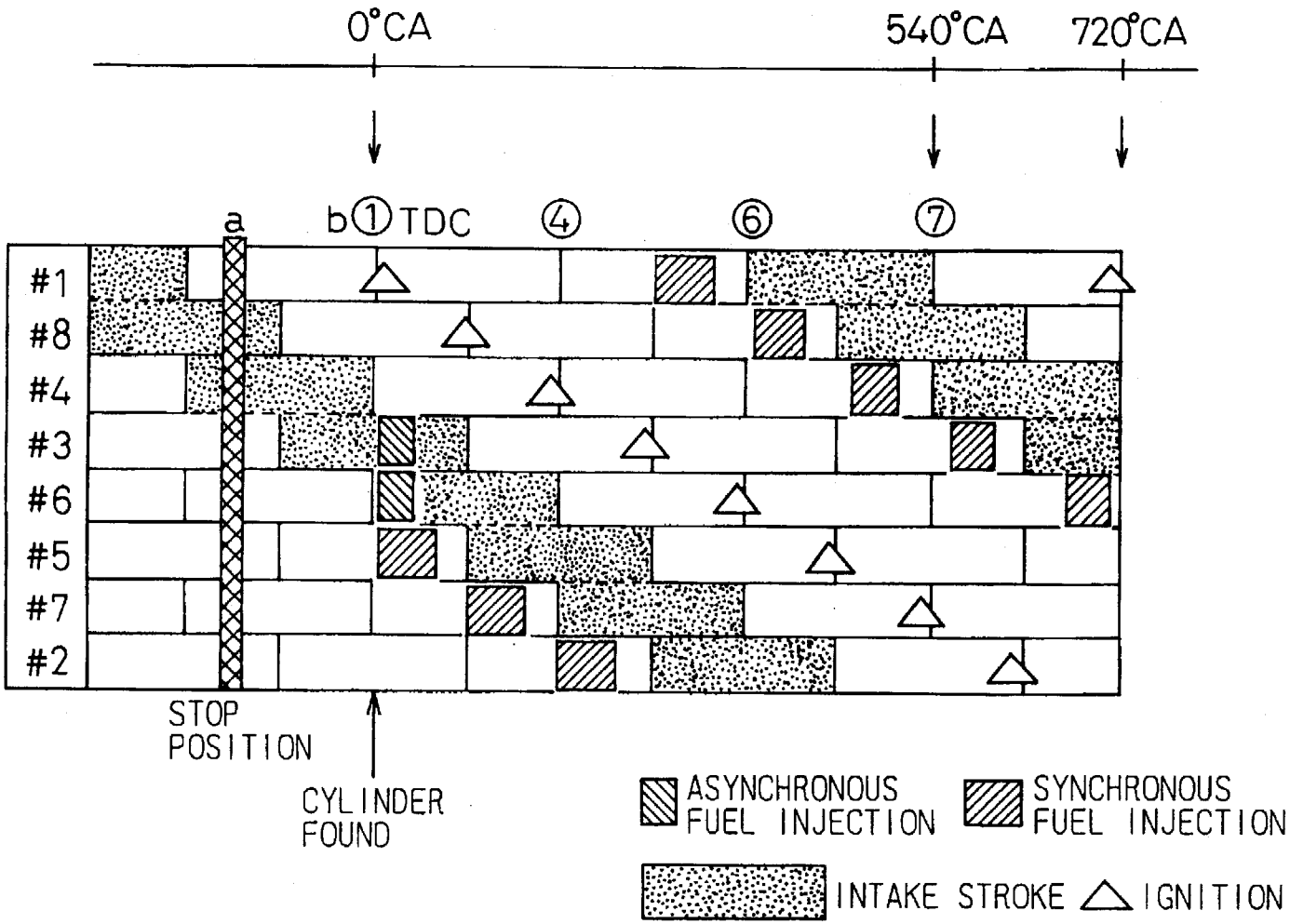
FIG. 4 is a time chart showing injection and ignition timing according to the routine of FIG. 3.

FIG. 3 is a flowchart showing a fuel injection controlling routine according to the present invention, and FIG. 4 is a time chart showing injection and ignition timing of the routine. The routine is a 30-degree-crank-angle routine, which is carried out in response to an output pulse from the crank angle sensor 32 to the input port 45. Namely, the routine is carried out every 30 degrees in crank angle. The routine starts when an ignition switch is turned on and ends when the switch is turned off. For the sake of convenience, the fuel injection control of the present invention is explained in connection with an eight-cylinder engine but the present invention is also applicable to four- and six-cylinder engines. Step 107 corresponds to the unit A for determining an engine speed, step 109 to the unit B for determining whether or not fuel in a cranking quantity has been injected into every cylinder, and steps 107 to 110 to the unit C for switching fuel injection quantities from one to another.

Step 101 determines whether or not a cylinder is detected, i.e., if there is an output pulse from the cylinder sensor 34. If there is no output pulse from the cylinder sensor 34 after the start of the routine, it is determined that no cylinder is detected yet, and the routine ends. If the cylinder sensor 34 provides an output pulse, it is determined that a cylinder has been detected, and step 102 is carried out.

Step 102 determines whether or not it is the first fuel injection timing, i.e., whether or not it is time to execute asynchronous fuel injection to start the engine. This embodiment carries out asynchronous fuel injection to specific cylinders as soon as a given cylinder is detected, thereby quickening an initial burning after a cranking operation.

Accordingly, step 102 determines whether or not it is just after the detection of a cylinder. If step 102 determines YES, i.e., if it is the first time to carry out step 102, steps 103 to 105 are carried out. If step 102 determines NO, i.e., if it is not the first time to carry out step 102, step 106 is carried out.

Step 103 multiplies a cranking quantity TAUST of fuel, which is injected to start the engine, by a reduction coefficient k (k<1), to calculate an asynchronous injection quantity tTAU. Calculating the cranking quantity TAUST will be explained with reference to FIG. 5.

Figure 5:
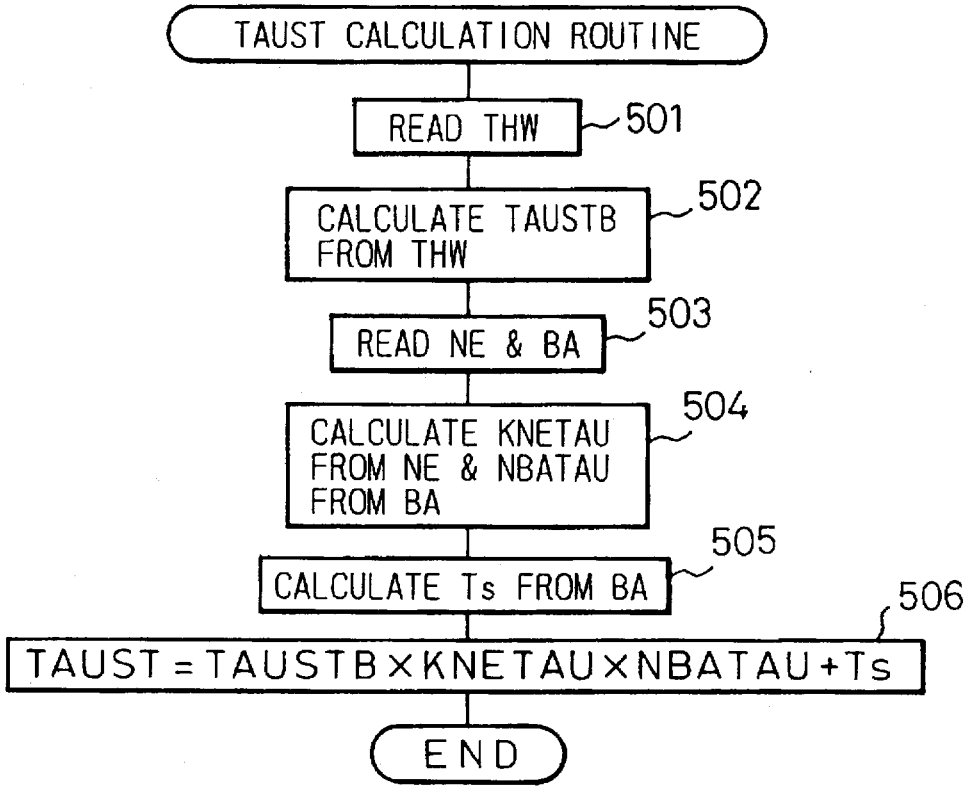
FIG. 5 is a flowchart showing a routine of calculating a cranking quantity TAUST of fuel to inject.

FIG. 5 is a flowchart showing a routine of calculating the cranking quantity TAUST of fuel to inject for starting the engine. The routine is carried out in the main routine. Step 501 reads the temperature THW of cooling water in the water jacket of the engine block 1 according to the output of the water temperature sensor 30. Step 502 retrieves, according to the temperature THW, a basic quantity TAUSTB of fuel to inject from a map stored in the ROM 42. Step 503 reads an engine speed NE from the crank-angle sensor 32 as well as a battery voltage BA from an A/D converter (not shown). Step 504 retrieves, according to the engine speed NE and battery voltage BA, correction coefficients KNETAU and NBATAU from maps stored in the ROM 42. Step 505 retrieves, according to the battery voltage BA, an ineffective injection time Ts from a map stored in the ROM 42. Then, step 506 calculates the cranking quantity TAUST as follows:

$$TAUST=TAUSTB\times KENTAU\times NBATAU+T_S \text{ (ms)}$$

Returning to the flowchart of FIG. 3, step 104 selects, as cylinders in which the asynchronous fuel injection is carried out, the third and sixth cylinders that are each in an intake stroke if step 101 detects a compression top dead center of the first cylinder, the fifth and seventh cylinders if step 101 detects a compression top dead center of the fourth cylinder, the second and first cylinders if step 101 detects a compression top dead center of the sixth cylinder, and the eighth and fourth cylinders if step 101 detects a compression top dead center of the seventh cylinder.

Step 105 injects fuel in the asynchronous injection quantity tTAU calculated in step 103 from the fuel injectors 12 toward the intake ports 13 of the cylinders set in step 104.

Step 106 detects synchronous injection timing. If step 106 detects the same, step 107 is carried out, and if not, the routine ends.

Step 107 checks a cranking flag XSTEFI. The flag is set to "1" when a battery voltage is supplied to the electronic control unit 40 and is reset to "0" when the engine speed NE exceeds 400 rpm (cranking speed). If XSTEFI=1, step 108 is carried out, and if XSTEFI=0, step 109 is carried out.

Step 108 sets the cranking quantity TAUST as a synchronous injection quantity tTAU, if step 107 determines that the engine speed NE is below 400 rpm, or if step 109 determines that the crank angle is smaller than 540 degrees to indicate that fuel in the cranking quantity TAUST is not yet injected into every cylinder after step 101 has detected a cylinder for the first time.

Step 109 determines whether or not the crank angle is larger than 540 degrees to see if fuel in the cranking quantity TAUST has been injected into every cylinder, after step 101 has detected a cylinder for the first time and after step 107 has determined that the engine speed NE is above 400 rpm. If step 109 determines YES, step 110 is carried out, and if it determines NO, step 108 is carried out.

Step 110 sets a post-cranking quantity TAU of fuel, which is injected after the engine is started, as the synchronous injection quantity tTAU. Calculating the post-cranking quantity TAU will be explained with reference to FIG. 6.

Figure 6:
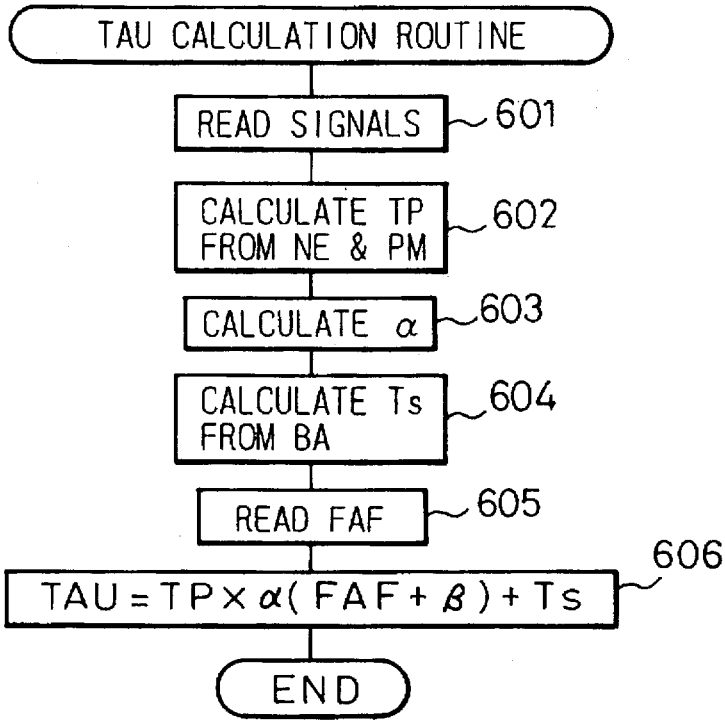
FIG. 6 is a flowchart showing a routine of calculating a post-cranking quantity TAU of fuel to inject.

FIG. 6 is a flowchart showing a routine of calculating the post-cranking quantity TAU of fuel to inject after the engine is started. This routine is carried out in the main routine. Step 601 reads various input signals. Step 602 retrieves, according to an engine speed NE and an intake air pressure PM both read in step 601, a basic quantity TP from a two-dimensional map stored in the ROM 42. Step 603 sets a correction coefficient α according to the temperature THW of cooling water, a throttle opening TO, the temperature of intake air TA, etc. Step 604 retrieves, according to a battery voltage BA, an ineffective injection time Ts from a map stored in the ROM 42. Step 605 reads an air-fuel-ratio correction coefficient FAF calculated by another routine (not explained). The coefficient FAF is a feedback correction coefficient used with the output of the air-fuel-ratio sensor 31 to calculate the quantity of fuel to inject to attain a target air-fuel ratio. Step 606 calculates the post-cranking quantity TAU as follows:

$$TAU=TP\times\alpha(FAF+\beta)+Ts$$

where β is a correction coefficient other than the coefficient FAF.

Returning to the flowchart of FIG. 3, step 111 successively sets cylinders in which the synchronous fuel injection is carried out, according to the cylinder detected in step 101.

Step 112 injects fuel in the synchronous injection quantity TAU set in step 108 or 110 from the fuel injector 12 toward the intake port 13 of the cylinder set in step 111.

FIG. 4 shows the details of the fuel injection control according to the present invention with the first cylinder being at a position "a" when the engine is stopped. Under this condition, a starter switch is turned on to restart the engine. In FIG. 4, the abscissa represents crank angles, and the ordinate represents cylinder numbers. The cylinders are ignited in order of #1, #8, #4, #3, #6, #5, #7, and #2. A triangle mark indicates ignition timing. A part hatched from upper left to lower right is an asynchronous fuel injection period, and a part hatched from upper right to lower left is a synchronous fuel injection period. A dotted area indicates an intake stroke. If the first cylinder (#1) is at a position "b" that is 45 degrees ahead of a crank-angle-zero position ①, starter noise may cause a problem. In this case, the top dead center of the fourth cylinder instead of the first cylinder is detected.

When the starter switch is turned on to restart the engine, a self-starter motor turns the engine. The cylinder sensor 34 provides an output pulse indicating the top dead center of the first cylinder. From the top dead center of the first cylinder corresponding to the crank-angle-zero position, ignition and fuel injection are started. At this moment, asynchronous fuel injection in the cranking quantity is carried out on the third and sixth cylinders, which are each in an intake stroke. At synchronous fuel injection timing, synchronous fuel injection in the cranking quantity is carried out on the fifth cylinder. Thereafter, at synchronous fuel injection timing, the synchronous fuel injection is successively carried out on the cylinders in order of #7, #2, #1, #8, #4, #3, and #6.

The eighth and fourth cylinders may each have residual fuel and high-concentration gas accumulated in an intake stroke in an interval from the start of the engine to the crank-angle-zero position (corresponding to the top dead center of the first cylinder). The fuel in the eighth cylinder will be ignited and will burn around a crank angle of 90 degrees due to a mixture of intake air and the residual fuel. Similarly, the fuel in the fourth cylinder will be ignited and will burn around a crank angle of 180 degrees (corresponding to the top dead center of the fourth cylinder) due to a mixture of intake air and the residual fuel. This may increase the engine speed to above 400 rpm before fuel in the cranking quantity is injected into every cylinder. For example, synchronous fuel injection in the cranking quantity will not be carried out on the eighth and fourth cylinders. Instead, fuel in the post-cranking quantity will be injected into these cylinders, to cause lean misfires due to a shortage of fuel caused by fuel adhesion to the wall of the intake duct.

To prevent such misfires, the present invention never switches the quantity of fuel to inject from the cranking quantity to the post-cranking quantity even if the engine speed exceeds 400 rpm, as long as the crank angle is smaller than 540 degrees to indicate that fuel in the cranking quantity is not yet injected into every cylinder after the cylinder sensor 34 has found a cylinder for the first time.

As explained above, the present invention provides a method of, and an apparatus for, controlling fuel injection of an internal combustion engine, which switch the quantity of fuel to inject from a cranking quantity to a post-cranking quantity only after confirming that the speed of the engine is over a reference speed and that fuel in the cranking quantity has been injected into every cylinder, thereby preventing lean misfires and a discharge of unburned HC and improving the exhaust purifying performance of the engine.

What is claimed is:

1. An apparatus for controlling fuel injection in an internal combustion engine by injecting fuel in a cranking quantity at the start of the engine and in a post-cranking quantity after the engine is started, comprising:

means for determining whether or not the speed of the engine is above a reference speed;

means for determining whether or not fuel in the cranking quantity has been injected into every cylinder of the engine; and means for switching the quantity of fuel to be injected from the cranking quantity to the post-cranking quantity if it is determined that the engine speed is above the reference speed and that fuel in the cranking quantity has been injected into every cylinder.

2. A method of controlling fuel injection in an internal combustion engine by injecting fuel in a cranking quantity at the start of the engine and in a post-cranking quantity after the engine is started, comprising the steps of:

determining whether or not the speed of the engine is above a reference speed;

determining whether or not fuel in the cranking quantity has been injected into every cylinder of the engine; and switching the quantity of fuel to be injected from the cranking quantity to the post-cranking quantity if it is determined that the engine speed is above the reference speed and that fuel in the cranking quantity has been injected into every cylinder.

* * * * *